US006068566A

United States Patent [19]

Kim

[11] Patent Number: 6,068,566

[45] Date of Patent: May 30, 2000

[54] DEVICE FOR DRIVING A CHILDCARE APPARATUS FOR INFANTS

[76] Inventor: Do Hyong Kim, Kaenari Apartment, Yoksam-dong, Kangnam-Ku, Seoul, Rep. of Korea

[21] Appl. No.: 09/136,654

[22] Filed: Aug. 19, 1998

[30] Foreign Application Priority Data

Dec. 31, 1997 [KR] Rep. of Korea ..... 97-44309

[51] Int. Cl.[7] ..... F16H 7/00; A47D 9/02

[52] U.S. Cl. ..... 474/84; 474/86; 5/109; 5/108

[58] Field of Search ..... 474/84, 87, 86, 474/85, 150, 148, 101; 5/108, 109; 74/44

[56] References Cited

U.S. PATENT DOCUMENTS

| | | | |
|---|---|---|---|
| 4,044,633 | 8/1977 | Lee | 474/86 X |
| 4,090,348 | 5/1978 | DeVittorio | 474/86 X |
| 4,211,401 | 7/1980 | Cunard | 5/109 X |
| 4,911,499 | 3/1990 | Meeker | 5/109 X |
| 5,228,155 | 7/1993 | Shultz et al. | 5/109 |
| 5,314,386 | 5/1994 | Eide et al. | 474/84 |
| 5,711,045 | 1/1998 | Caster et al. | 5/109 |

*Primary Examiner*—David A. Bucci
*Assistant Examiner*—Marcus Charles
*Attorney, Agent, or Firm*—Ladas & Parry

[57] ABSTRACT

A device for reciprocating a bed or cradle on supporting rods has a driving pulley (1) on a rotational first axle (50) of a driving motor (M) and a first decelerating pulley (2) on a second axle (23). The first decelerating pulley is connected to the driving pulley (1) by a first belt (7A). A first small pulley (3) on the second axle (9A) is connected to a second decelerating pulley (4) on a third axle (9B) by a second belt (7B). A second small pulley (5) on the third axle (9B) is connected to a third decelerating pulley (6) on a driving axle (8) by a third belt (7C). A disk (11) axially on the driving axle (8) has an eccentric axle (12) thereon. An idle cap (13) on the eccentric axle (12) for rotation has springs (14 and 14*a*) on opposite sides thereof. Supporting rods (16) are respectively connected to the springs (14 and 14*a*) for being moved back and forth or from side to side by tension of the springs (14 and 14*a*) as the rotational disk (11) is rotating.

13 Claims, 8 Drawing Sheets

DEVICE FOR DRIVING A CHILDCARE APPARATUS FOR INFANTS

BACKGROUND OF THE INVENTION

1. Field of the Invention

The present invention relates to a device for driving a childcare apparatus to enable a babycot or a cradle for a growing infant to swing repeatedly and, more particularly, to a device for driving a childcare apparatus tp enable a babycot or a cradle for a growing infant to swing automatically from side to side or back and forth by the driving force of a motor when the power is turned on while an infant is sitting on or lying in the childcare apparatus, and consequently to have the infant fall asleep or take a rest comfortably, where this device is applicable to a babycot or a cradle.

2. Description of the Related Art

Conventional childcare apparatuses for growing infants include swings or cradles which are hung up, and cots or cradles which are supported by a lower part thereof. And, most of those apparatuses are designed to be moved only by a external force as inflicted thereon. Therefore, there has been a demand for development of a novel childcare apparatus which can care and please an infant automatically by itself without any external force, while his or her mother alone takes care of household affairs.

FIG. 8 is a view of a conventional device for driving a childcare apparatus proposed in response to such a demand.

Referring to FIG. 8, a decelerating gear 102 is geared with an axis 101 of a motor 100 through a driving gear 103 and a driving wheel 105 rotates about a driving axis 104 as formed in a final decelerating gear. This mechanism forces an operating rod 107, which is fixed to an eccentric projection 106 of the driving wheel 105 so that it may be revolved, to make a reciprocating motion, and consequently to swing supporting rods connected with the operating rod 107. As the support rods are swinging, a bed having a sit frame mounted on the supporting rods is moving back and forth, which causes an infant alone to fall asleep or take a rest with a pleasant feeling.

However, the above mechanism is based on the engagement of gears and therefore a rapid rotation accompanies a noise due to mechanical friction among them, causing the infant to instably fall asleep or take a rest. Unfavorably, it is also required to use a unnecessary large-capacity motor in order to avoid damages of the motor from an overload since the bed can be operated only by the rotation of a motor.

SUMMARY OF THE INVENTION

Accordingly, an objective of the present invention is to provide a device for driving a childcare apparatus for infants which is adapted to minimization of a noise generated from a motor by installing decelerating pulleys driven by a belt around the rotational axis of the motor, and reduce the load of the motor by a construction that the decelerating pulleys have a driving axis to make a rotational motion of a disk mounted onto the driving axis, and an idle cap having springs at its both ends in a symmetrical manner is inserted into the eccentric axis of the rotational disk, and the ends of the springs are connected to supporting rods on which a bed or cradle is mounted, thereby while the supporting rods are moving back and forth or from side to side, the tension of either spring pulls alternately either supporting rod oppositely to the direction in which either supporting rod is moving, enabling the load of the motor to be reduced considerably.

In an aspect of the present invention, a device for automatically driving a bed includes: a driving pulley formed on a rotational axis of a driving motor; a first decelerating pulley connected to the driving pulley through a belt; small pulleys formed on the same axis with the first decelerating pulley; second and third decelerating pulleys being engaged with the small pulleys through the belt, thereby rotating a driving axis which is exposed to the exterior, wherein the first, second and third accelerating pulleys are installed in a housing; a rotational disk fixed on the driving axis inserted thereinto; an idle cap having springs formed on both ends thereof, the idle cap being fixed on an eccentric axis of the rotational disk so that it may be freely idled; a fixing cap fastened on the eccentric axis on the idle cap lest the idle cap should be separated from the eccentric axis; a screw fastened on the fixing cap; supporting rods each connected to the ends of the springs formed on both ends of the idle cap through coupling pieces; and a sit frame mounted on the supporting rods and having a bed or cradle installed thereon, wherein the supporting rods are moved back and forth or from side to side partly by the tension of either spring pulls alternately either supporting rod oppositely to the direction in which either supporting rod is moving, enabling the load of the motor to be reduced considerably.

BRIEF DESCRIPTION OF THE INVENTION

DESCRIPTION OF THE PREFERRED EMBODIMENTS

Hereinafter, the present invention will be described by way of illustrative examples with reference to the accompanying drawings.

Figure 1:
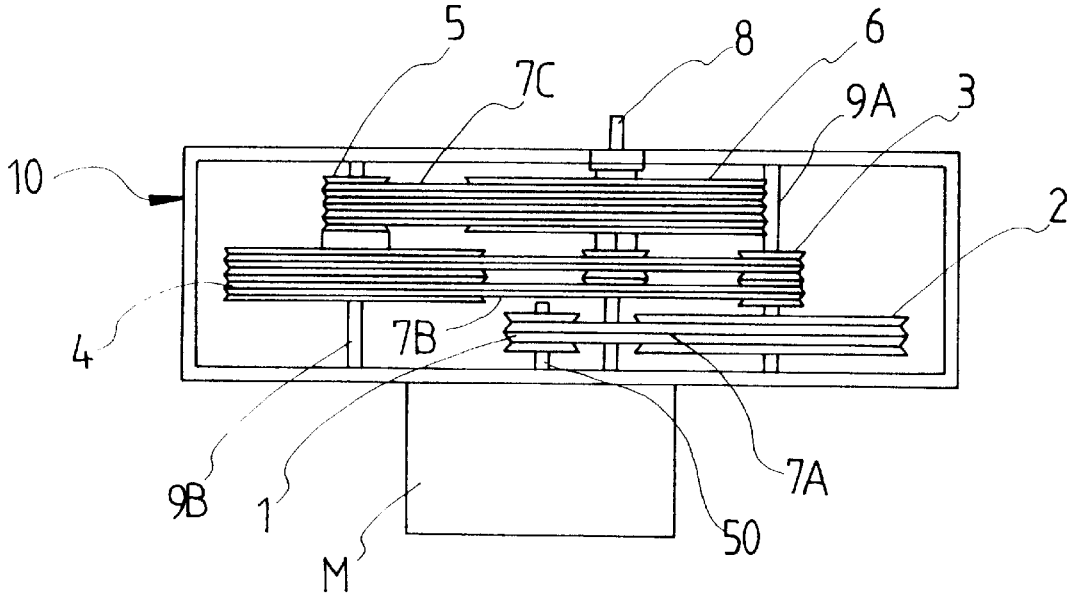
FIG. 1 is a cross-sectional view illustrating engagement of pulleys installed in a housing in accordance with the present invention.
Figure 2:
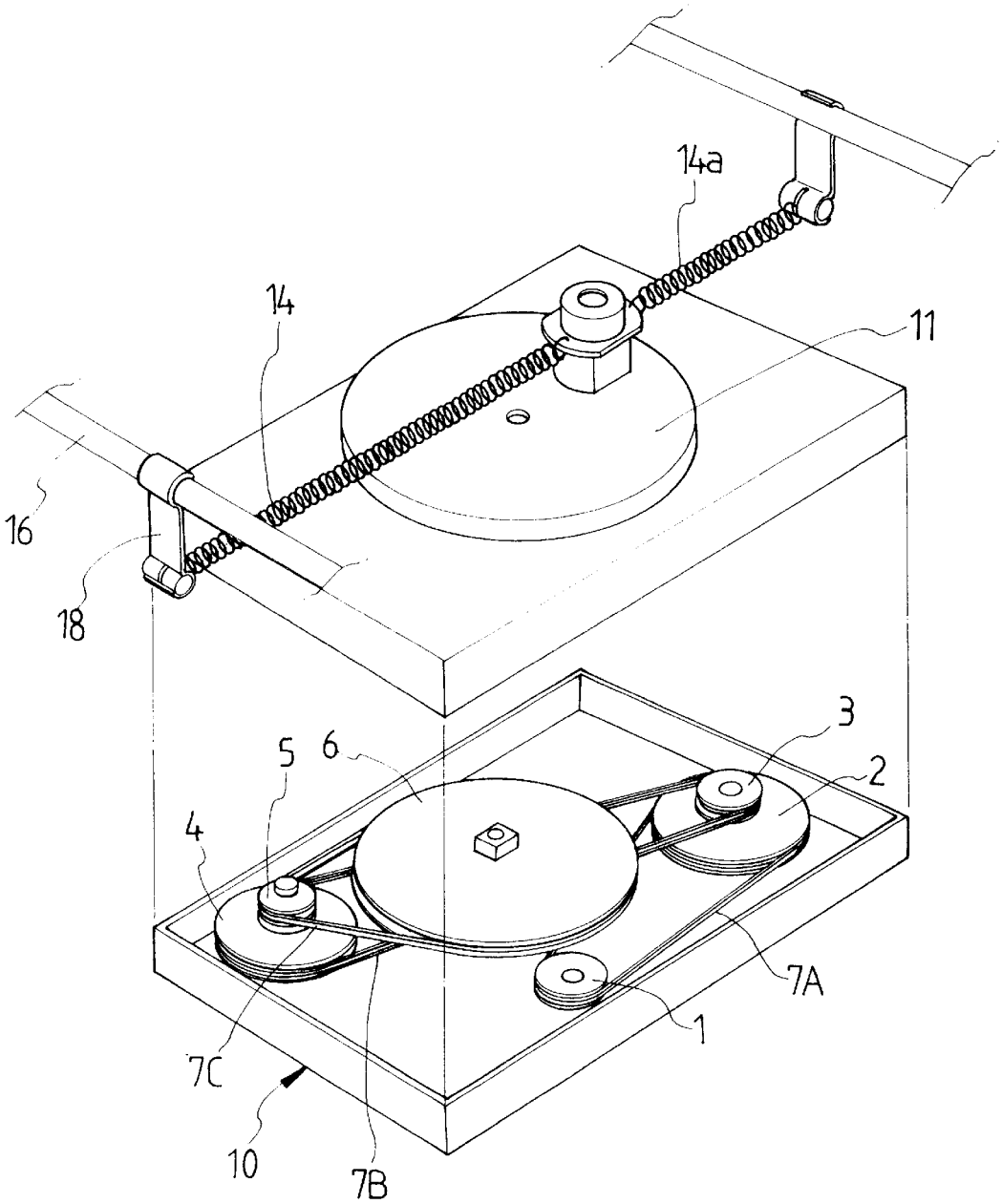
FIG. 2 is a perspective view illustrating a state that a rotational disk is combined with supporting rods in the present invention.
Figure 3:
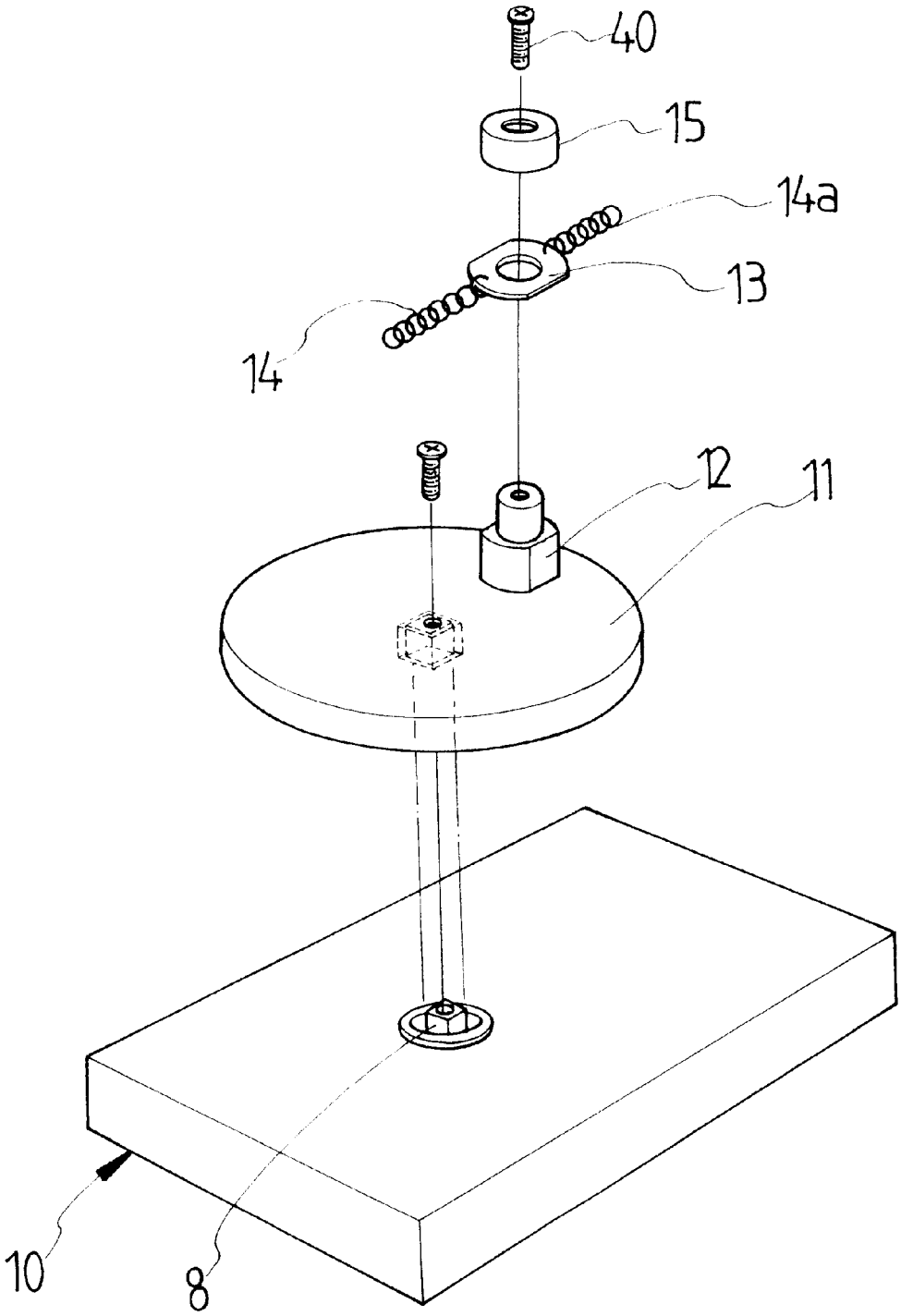
FIG. 3 is an exploded perspective view showing a composition of the rotational disk in the present invention.
Figure 4:
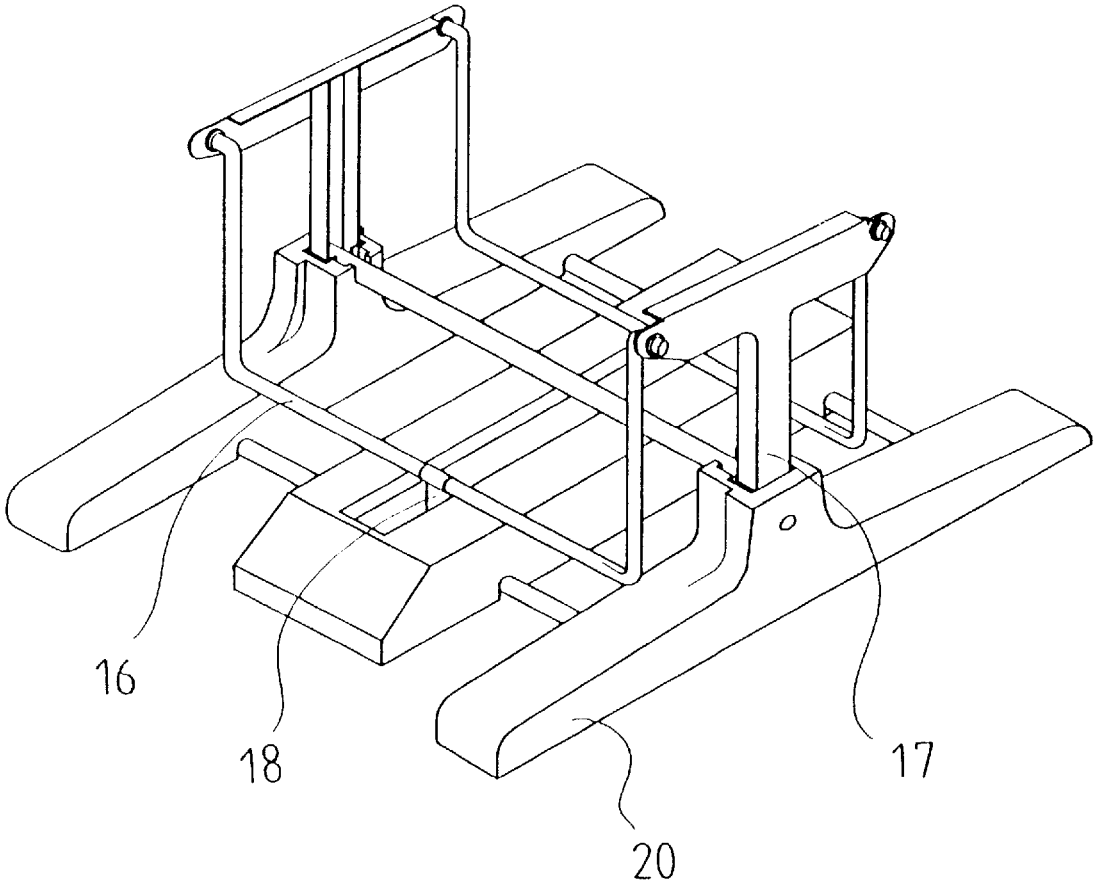
FIG. 4 is a perspective view illustrating the device in operation as the coupling pieces of springs are combined with supporting rods in the present invention.
Figure 5:
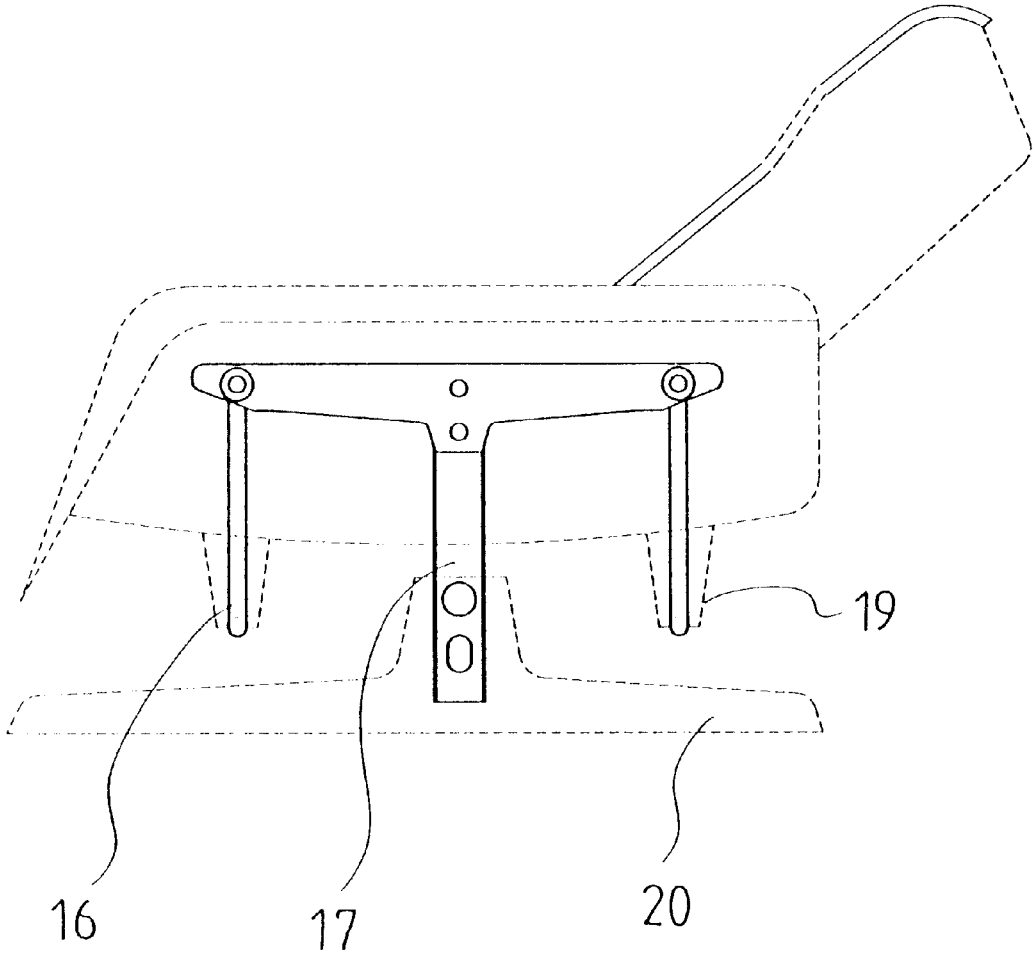
FIG. 5 is a view illustrating a state that a sit frame of the bed is mounted on the supporting rods in the present invention.
Figure 6:
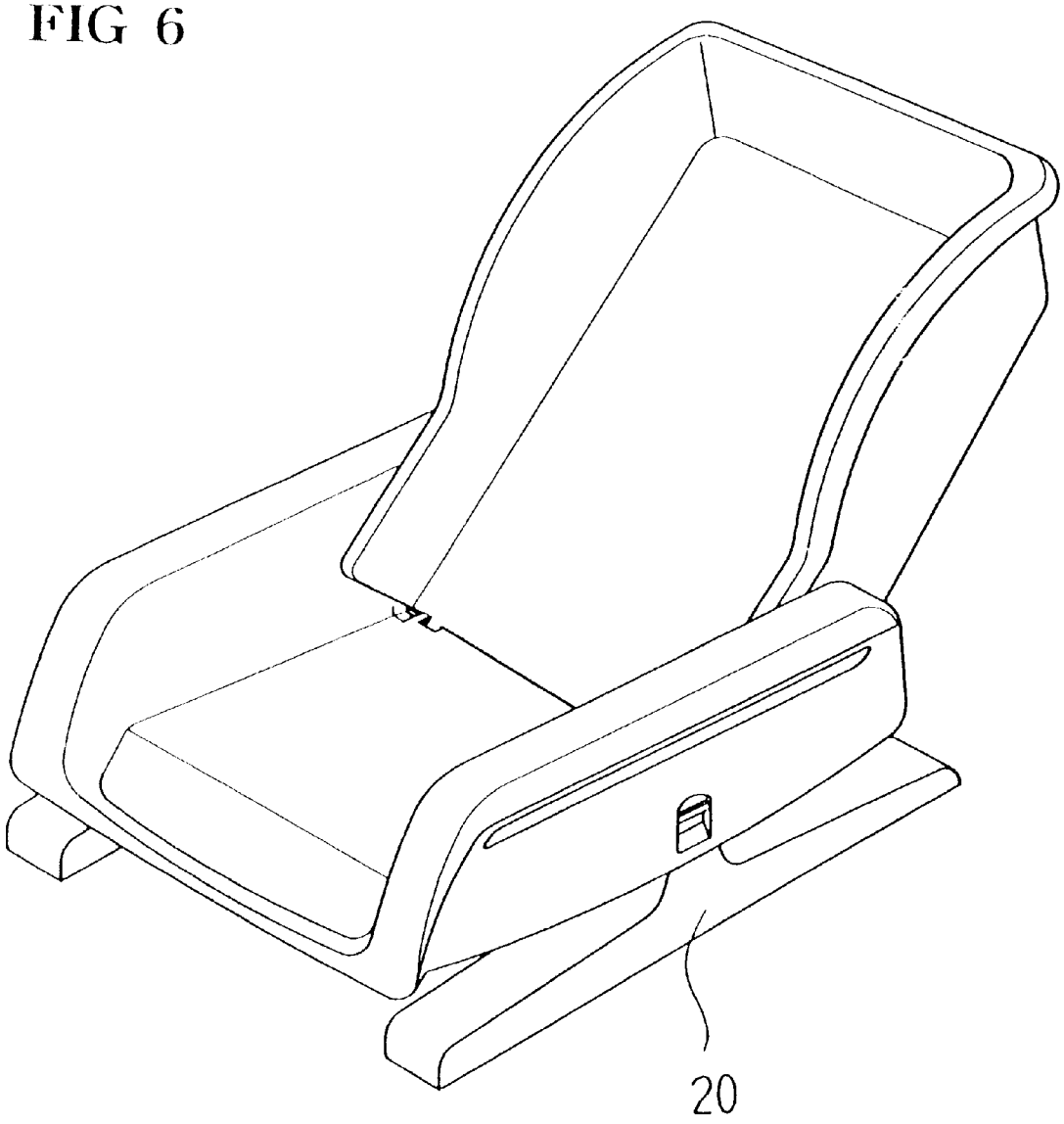
FIG. 6 is a perspective view of the bed.
Figure 7:
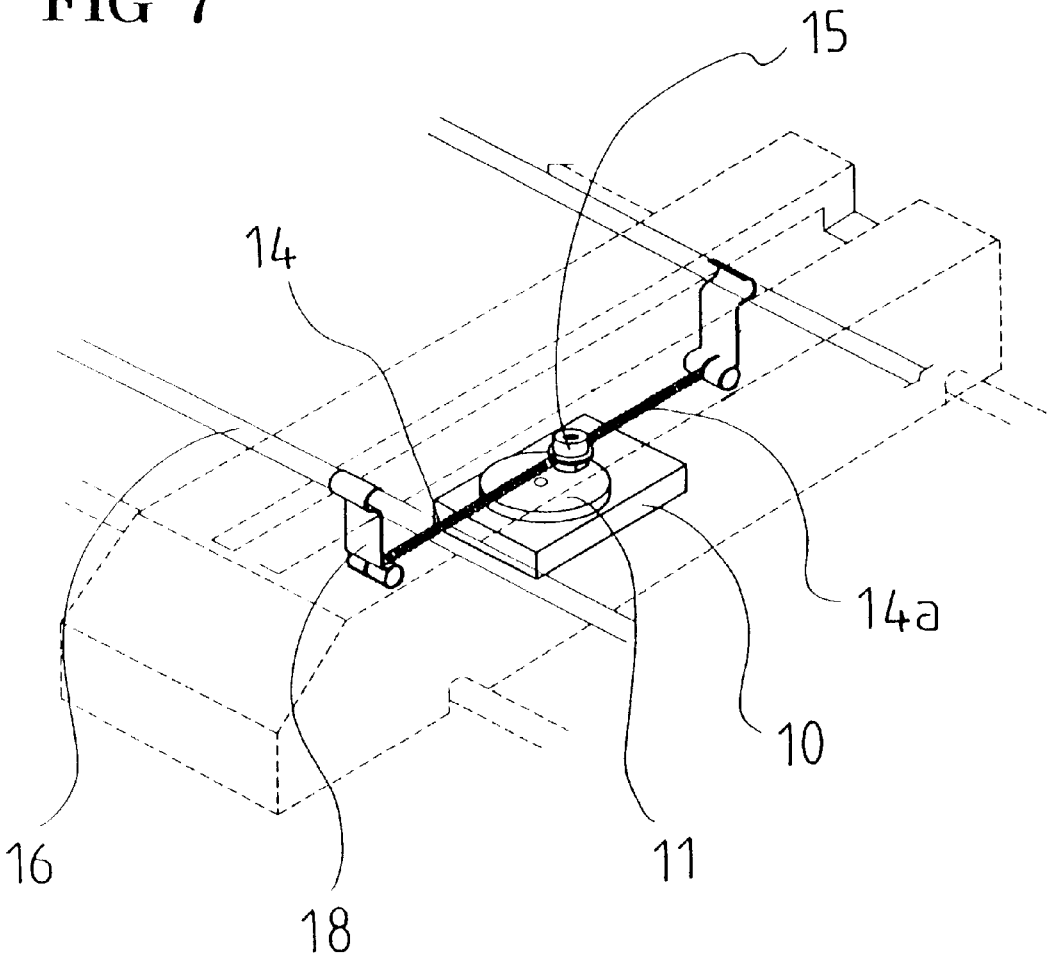
FIG. 7 is a view illustrating a state that the rotational disk has been received in a recieving chamber in the present invention.
Figure 8:
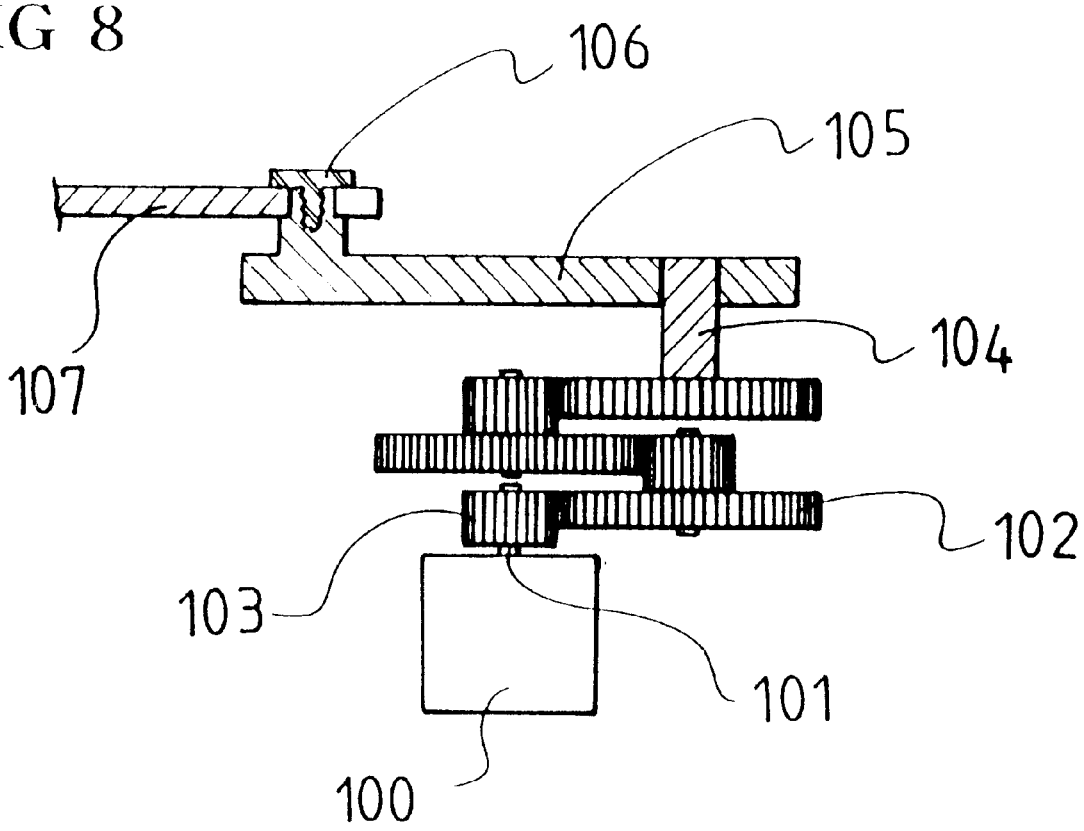
FIG. 8 is a cross-sectional view illustrating a conventional driving mechanism in a conventional childcare apparatus.

As shown in FIG. 1, a driving pulley 1 is formed on a rotational axle 50 of a driving motor M and connected to a first decelerating pulley through a belt 7A. A small pulley 3 which is formed on the same axle 9A with the first decelerating pulley 2 gets in engagement with a second decelerating pulley 4, while a small pulley 5 formed on the same axle 9B with the second decelerating pulley 4 is engaged with a third decelerating pulley 6 through belts 7B and 7C. The respective pulleys are formed within a housing 10 by the axles. An externally exposed driving axis 8 is fixedly inserted axially into a rotational disk 11. An eccentric axle 12 of the rotational disk 11 is fixedly inserted into an idle cap 13 having springs 14 and 14*a* on both sides and is further fastened with a fixing cap 15 lest the idle cap 13 should be separated from the eccentric axis 12. A screw 40 is also fixed on the fixing cap 15. The respective ends of the springs 14 and 14*a* formed on both ends of the idle cap 13 are fixed to supporting rods 16 with coupling pieces 18. A sit frame 19 with a bed or cradle placed thereon is mounted on the supporting rods 16. As the rotational disk 11 is rotating, the tension of the springs 14 and 14*a* pulls respectively and alternately either supporting rod oppositely to the direction in which either supporting rod moves, and consequently enabling the supporting rods 16 to move back and forth, or from side to side. Also an elastic made by the silicone is used for substitution of the springs 14 and 14*a*.

The supporting rods 16 are fixed to both ends of a T-shaped supporting frame 17 so that they may be freely movable, which is fixedly inserted into a lower body 20 of the bed.

Further, the sit frame 19 mounted on the round supporting rods 16 has preferably a curved bottom face for the purpose to get the device in smooth operation.

When the power is turned on for the driving device of the present invention as constructed above, the driving motor M is rotated and the rotating speed get to be decelerated by the first, second and third decelerating pulleys 2, 4 and 6 as driven by the rotation of the driving motor M. While the rotational disk 11 which is fixed on the driving axis 8 of the third decelerating pulley 6 rotates, the idle cap 13 as inserted into the eccentric axle 12 of the rotational disk 11 makes a rotational motion simultaneously, generating tension of the springs 14 and 14*a* alternately from side to side. Meanwhile, the supporting rods 16 which are connected to the springs 14 and 14*a* via the coupling pieces 18, get to swing back and forth, or from side to side, and thereby the sit frame 19 of a bed or a cradle mounted on the supporting rods 16 get to swing back and forth, or from side to side.

Wherein, the bed or the cradle gets to swing simultaneously while the sit frame 19 mounted on the supporting rods 16 gets to swing because the supporting rods 16 are installed in the supporting frame so that they may be freely movable.

As the idle cap 13 gets to be idled at the eccentric axle 12, the springs 14 and 14*a* is moved from side to side in a straight line without being twisted each other.

Accordingly, through the above iterative operation, the bed gets to be moved back and forth, or from side to side.

Such as in the present invention described above, there is provided a device for driving a bed to move back and forth, or from side to side with a simple construction such that the fixed axle is moving on a circle along the circumference of the operational disk fixed to the rotational axis of the motor and the springs fixed on both ends of the idle cap as inserted into the eccentric axle externally projected from the fixed axle pull the bed alternately back and forth, or from side to side, and whereby it is possible to enhance the work efficiency in manufacturing beds and further provide more inexpensive automatic beds for infants.

What is claimed is:

1. A device for driving a bed or cradle on supporting rods, the device comprising:

a driving pulley (1) on a rotational first axle (50) of a driving motor M;

a first decelerating pulley (2) on a second axle (9A), the first decelerating pulley being connected to the driving pulley (1) by a first belt (7A);

a first small pulley (3) on the second axle (9A);

a second decelerating pulley (4) on a third axle (9B), the second decelerating pulley (4) being connected to the first small pulley (3) by a second belt (7B);

a second small pulley (5) on the third axle (9B);

a third decelerating pulley (6) on a driving axle (8), the third decelerating pulley (6) being connected to the second small pulley (5) by a third belt (7C);

a rotational disk (11) axially on the driving axle (8) and having an eccentric axle (12) thereon;

an idle cap (13) having springs (14 and 14*a*) on opposite sides thereof, the idle cap (13) being on the eccentric axle (12) for rotation;

supporting rods (16) respectively connected to the springs (14 and 14*a*) for being moved back and forth, or from side to side by tension of the springs (14 and 14*a*) as the rotational disk (11) is rotating.

2. A device for reciprocating a bed or cradle, the device comprising:

a first axle for rotation by a motor;

a driving pulley on the first axle for rotation therewith;

a driving axle;

belt and decelerating-pulley means comprising a first belt drivingly about the driving pulley and a first decelerating pulley for rotating the driving axle;

a disk axially on the driving axle for rotation therewith;

an axle eccentrically on the disk;

an idle cap on the axle eccentrically on the disk for rotation relative to the disk; and springs respectively connected to opposite sides of the idle cap, whereby connecting means for respectively connecting the springs with a bed or cradle reciprocate the bed or cradle in response to the rotation of the disk.

3. The device according to claim 2, wherein the belt and decelerating-pulley means further comprise at least one further belt and decelerating pulley combination for the rotating of the driving axle.

4. The device according to claim 2, and further comprising a housing about the driving pulley and belt and decelerating-pulley means.

5. The device according to claim 3, and further comprising a housing about the driving pulley and belt and decelerating-pulley means.

6. The device according to claim 2, and further comprising the connecting means, wherein the connecting means comprises parallel supporting rods movably on a supporting frame for the respective connection to the springs and receiving thereon the bed or cradle to be reciprocated.

7. The device according to claim 3, and further comprising the connecting means, wherein the connecting means comprises parallel supporting rods movably on a supporting frame for the respective connection to the springs and receiving thereon the bed or cradle to be reciprocated.

8. The device according to claim 4, and further comprising the connecting means, wherein the connecting means comprises parallel supporting rods movably on a supporting frame for the respective connection to the springs and receiving thereon the bed or cradle to be reciprocated.

9. The device according to claim 5, and further comprising the connecting means, wherein the connecting means comprises parallel supporting rods movably on a supporting frame for the respective connection to the springs and receiving thereon the bed or cradle to be reciprocated.

10. The device according to claim 6, wherein the supporting rods are U-shaped and pivoted on the supporting frame at opposite ends for rocking when moved.

11. The device according to claim 7, wherein the supporting rods are U-shaped and pivoted on the supporting frame at opposite ends for rocking when moved.

12. The device according to claim 8, wherein the supporting rods are U-shaped and pivoted on the supporting frame at opposite ends for rocking when moved.

13. The device according to claim 9, wherein the supporting rods are U-shaped and pivoted on the supporting frame at opposite ends for rocking when moved.

* * * * *